US009790052B2

(12) United States Patent
Kosaka

(10) Patent No.: US 9,790,052 B2
(45) Date of Patent: Oct. 17, 2017

(54) IMAGE FORMING APPARATUS

(71) Applicant: Brother Kogyo Kabushiki Kaisha, Nagoya-shi, Aichi-ken (JP)

(72) Inventor: Raizo Kosaka, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/086,381

(22) Filed: Mar. 31, 2016

(65) Prior Publication Data

US 2016/0289036 A1 Oct. 6, 2016

(30) Foreign Application Priority Data

Mar. 31, 2015 (JP) ..... 2015-070966

(51) Int. Cl.
*B65H 5/22* (2006.01)
*B65H 85/00* (2006.01)
*B65H 29/52* (2006.01)

(52) U.S. Cl.
CPC ..... *B65H 85/00* (2013.01); *B65H 29/52* (2013.01); *B65H 2301/33312* (2013.01); *B65H 2301/446* (2013.01); *B65H 2402/443* (2013.01); *B65H 2403/945* (2013.01); *B65H 2404/61* (2013.01); *B65H 2404/63* (2013.01); *B65H 2801/12* (2013.01)

(58) Field of Classification Search
CPC ..... B65H 2402/443; B65H 2404/61; B65H 29/60; B65H 85/00; B65H 2404/63
See application file for complete search history.

(56) References Cited

U.S. PATENT DOCUMENTS 8,448,941 B2 5/2013 Narikiyo
8,579,280 B2 * 11/2013 Ishikuro ..... B65H 29/52 271/184
2011/0221124 A1 9/2011 Narikiyo
2012/0038101 A1 * 2/2012 Osaki ..... B65H 31/26 271/209
2013/0266357 A1 10/2013 Egawa et al.

FOREIGN PATENT DOCUMENTS

JP 2006-021903 A 1/2006
JP 2008-037528 A 2/2008
JP 2008-162744 A 7/2008
(Continued)

*Primary Examiner* — Howard Sanders
(74) *Attorney, Agent, or Firm* — Banner & Witcoff, Ltd.

(57) ABSTRACT

An image forming apparatus, comprising: a housing having a sheet discharge tray, a first opening, and a second opening disposed on an upper side of the first opening; an image forming unit; a sheet discharge path communicating with the first opening; a re-conveying path communicating with the second opening; and a swinging member having a first surface facing the first opening and a second surface, wherein the swinging member has a first end area swingably supported by the housing, a second end area, and a rib; the swinging member is disposed to be movable between a first position and a second position at which the second end area gets higher; and the rib is formed on the second surface opposing the first surface facing the sheet discharge tray in a state where the swinging member is disposed at the second position.

15 Claims, 6 Drawing Sheets

(56) References Cited

FOREIGN PATENT DOCUMENTS

| | | | |
|---|---|---|---|
| JP | 2011-190038 | A | 9/2011 |
| JP | 2012020845 | A | 2/2012 |
| JP | 2013-040031 | A | 2/2013 |
| JP | 2013-216419 | A | 10/2013 |
| JP | 2015-030556 | A | 2/2015 |

* cited by examiner

1

IMAGE FORMING APPARATUS

CROSS-REFERENCE TO RELATED APPLICATION

This application claims priority under 35 U.S.C. §119 from Japanese Patent Application No. 2015-070966, filed on Mar. 31, 2015. The entire subject matter of the application is incorporated herein by reference.

BACKGROUND

Technical Field

Aspects of the present disclosures relate to an electrophotographic type image forming apparatus.

Related Art

Printers configured to reversing front and back sides of a sheet being conveyed to form images on both sides of the sheet are known.

One of the printers of this type includes an image forming unit configured to form an image on a sheet, a fixing unit configured to fix the image on the sheet, a sheet conveying path being a conveying path for discharging the sheet, a drawing path being a conveying path for reversing the sheet, a paper discharge tray disposed on an upper surface of a printer body, a guide which is disposed on an upper side of the paper discharge tray and is formed to continue the drawing path, and a reversing roller disposed on the drawing path.

In the printer described above, the sheet for which image formation has been finished is discharged to the paper discharge tray after passing through the fixing unit and the sheet conveying path. Regarding the sheet for which an image has been formed on one side of the sheet and an image it to be formed on the other side of the sheet, the sheet is guided to the drawing path after passing through the fixing unit. Then, the sheet entered the drawing path is conveyed again to the image forming unit by causing the reversing roller to inversely rotate in a state where the sheet is placed on the upper side of the paper discharge tray to be along the guide.

SUMMARY

In the above described printer, when the sheet enters the drawing path, the sheet being conveyed may contact the guide or the sheets placed on the paper discharge tray. When the sheet entering the drawing path contacts other components in this way, the conveying resistance of the sheet being re-conveyed may become large.

In consideration of the above, aspects of the present disclosures provide an image forming apparatus capable of smoothly re-conveying a sheet.

According to an aspect of the disclosures, there is provided an image forming apparatus, comprising: a housing having a sheet discharge tray, a first opening, and a second opening disposed on an upper side with respect to the first opening; an image forming unit configured to form an image on a sheet; a sheet discharge path configured to guide the sheet from the image forming unit to the sheet discharge tray, the sheet discharge path communicating with the first opening; a re-conveying path configured to be disposed side by side with the sheet discharge path in a horizontal direction and to guide the sheet to the image forming unit, the re-conveying path communicating with the second opening; and a swinging member disposed to face the first opening, the swinging member comprising a first surface disposed to face the first opening and a second surface opposite to the first surface. In this configuration, the swinging member further comprises a first end area at which the swinging member is swingably supported by the housing, a second end area opposing the first end area, and a rib formed to extend from the first end area to the second end area. The swinging member is disposed to be movable between a first position and a second position at which the second end area is disposed at a position higher than a position of the second end area defined when the swinging member is disposed at the first position. The rib is formed on the second surface of the swinging member opposing the first surface of the swinging member facing the sheet discharge tray in a state where the swinging member is disposed at the second position.

BRIEF DESCRIPTION OF THE ACCOMPANYING DRAWINGS

DETAILED DESCRIPTION

First Embodiment

Hereafter, an image forming apparatus 1 according to a first embodiment will be explained. In the following explanation, directions are referred to with reference to direction arrows shown in the accompanying drawings.

1. Overall Configuration of Image Forming Apparatus

Figure 1:
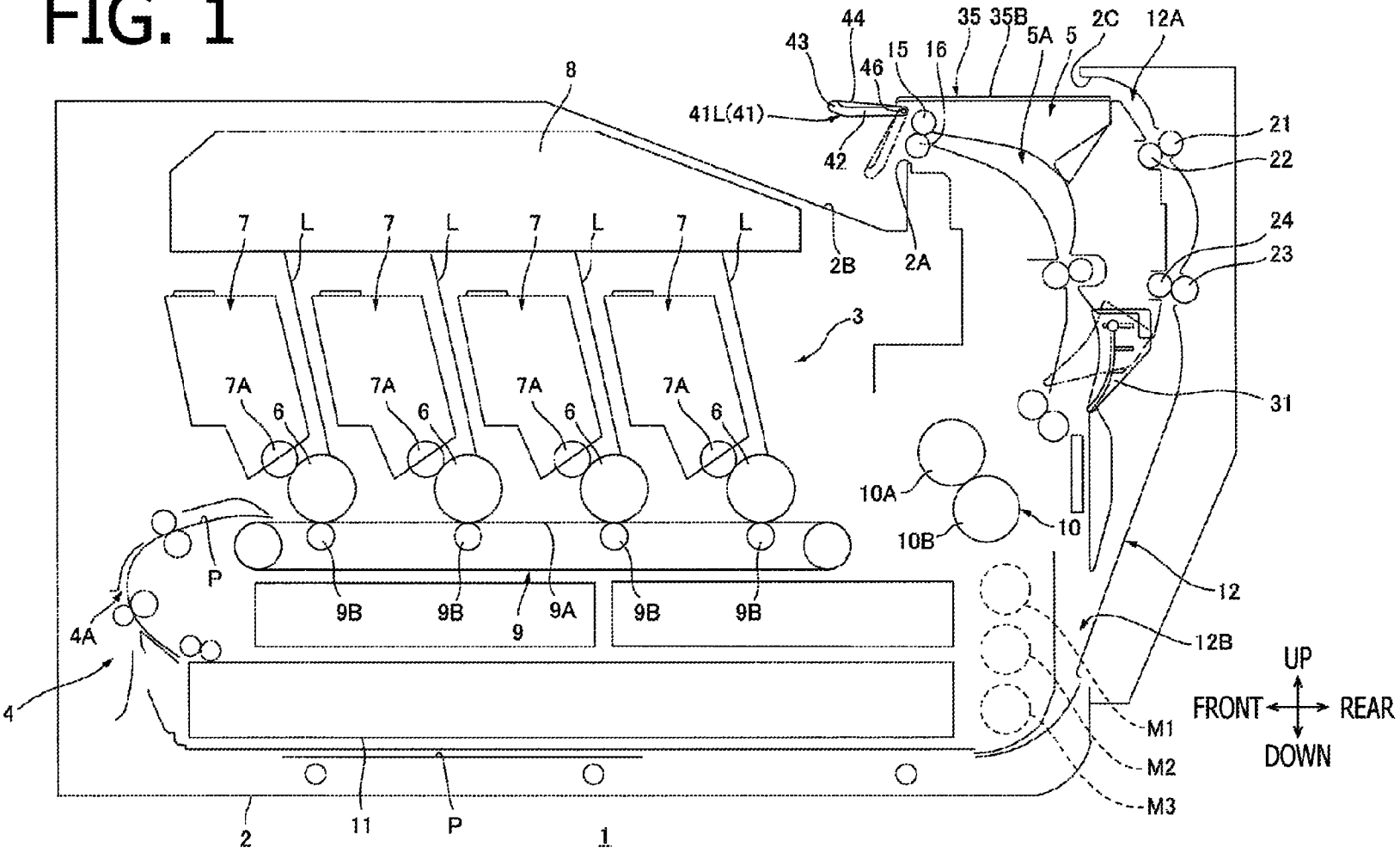
FIG. 1 is a central cross sectional view of a printer according to a first embodiment.

As shown in FIG. 1, the image forming apparatus 1 is a laser printer. The image forming apparatus 1 includes a housing 2 having a paper discharge opening 2A, an image forming unit 3, a paper supply unit 4 having a supply path 4A, and a paper discharge unit 5 having a paper discharge path 5A.

The housing 2 forms an outer covering of the image forming apparatus 1. The housing 2 has a box-shape. The housing 2 accommodates the image forming unit 3, the paper supply unit 4 and the paper discharge unit 5. The housing 2 includes a paper discharge tray 2B.

The paper discharge tray 2B is disposed on an upper wall of the housing 2. The paper discharge tray 2B has a recessed shape which is recessed from an upper surface of the housing 2.

The paper discharge opening 2A is disposed on an upper rear side of the paper discharge tray 2B. The paper discharge opening 2A is opened in the front and rear direction. With this configuration, the paper discharge opening 2A lets the inside and the outside of the housing 2 communicate with each other.

The image forming unit 3 is disposed in a central portion of the image forming apparatus 1. The image forming unit 3 includes a plurality of (four in this embodiment) photosensitive drums 6, a plurality of (four in this embodiment) developing devices 7, an exposing device 8, a transfer unit 9 and a fixing unit 10.

The four photosensitive drums 6 are disposed to be spaced from each other in the front and rear direction. Each photosensitive drum 6 has a cylindrical shape extending in the left and right direction.

The four developing devices 7 are disposed to be spaced from each other in the front and rear direction. Each developing device 7 is disposed on the upper front side of the corresponding photosensitive drum 6. The developing device accommodates toner. The developing device 7 includes a developing roller 7A.

The developing roller 7A is disposed at a lower rear end part of the developing device 7. The developing roller 7A contacts the corresponding photosensitive drum 6. The developing roller 7A supplies toner to the corresponding photosensitive drum 6.

The exposing device 8 is disposed above the four developing devices 7. The exposing device 8 is able to emit laser light L based on image data. The laser light L emitted from the exposing device 8 is incident on surfaces of the photosensitive drums 6 while passing through rear sides of the respective developing devices 7.

The transfer unit 9 is disposed under the four photosensitive drums 6. The transfer unit 9 is disposed to be along the front and rear direction. The transfer unit 9 includes a belt 9A and a plurality of (four in this embodiment) transfer rollers 9B.

The belt 9A is an endless belt. The belt 9A is disposed such that an upper surface of the belt 9A contacts the four photosensitive drums 6. The belt 9A is able to circulate such that the upper surface of the belt 9A moves from the front side to the rear side.

The four transfer rollers 9B are disposed to be spaced from each other in the front and rear direction. The transfer roller 9B is disposed on the lower side of the corresponding photosensitive drum 6. The transfer rollers 9B are disposed to sandwich the belt 9A between the transfer rollers 9B and the photosensitive drums 6.

The fixing unit 10 is disposed on the rear side of the transfer unit 9. The fixing unit 10 includes a heat roller 10A and a pressure roller 10B contacting the heat roller 10A.

The paper supply unit 4 is disposed in a lower end part of the image forming apparatus 1. The paper supply unit 4 is configured to supply a sheet (a sheet of paper P in the embodiment) to the image forming unit 3. The paper supply unit 4 includes a paper supply tray 11.

The supply path 4A is formed to extend upward from an upper front end part of the paper supply tray 11, to bend rearward, and to extend to the front side of the frontmost photosensitive drum 6.

The paper supply tray 11 is disposed under the transfer unit 9. The paper supply tray 11 is a tray capable of accommodating sheets of paper P.

The paper discharge unit 5 is disposed at a upper rear end part of the image forming apparatus 1. The paper discharge unit 5 is configured to discharge the sheet of paper P which has passed through the fixing unit 10, to the paper discharge tray 2B. The paper discharge unit 5 includes a paper discharge roller 15 and an opposing roller 16.

The paper discharge path 5A is formed to extend upward from an upper rear side of the fixing unit 10, to bend frontward, and to communicate with the paper discharge opening 2A.

The paper discharge roller 15 is disposed at a front end part of the paper discharge path 5A. The paper discharge roller 15 is able to rotate when a driving force from a driving source M1 is inputted thereto.

The opposing roller 16 is disposed at the front end part of the paper discharge path 5A. The opposing roller 16 is disposed under the paper discharge roller 15. The opposing roller 16 contacts the paper discharge roller 15. The opposing roller 16 is able to rotate following rotation of the paper discharge roller 15.

When the image forming apparatus 1 starts image forming operation, the exposing device 8 emits the laser light L to expose the surfaces of the photosensitive drums 6. As a result, an electrostatic latent image based on the image data is formed on each photosensitive drum 6.

Next, the toner is supplied to the electrostatic latent image on the surface of the photosensitive drum 6 by the development roller 7A. As a result, a toner image is held on the surface of the photosensitive drum 6.

Then, the sheet of paper P in the paper supply tray 11 is supplied one by one to a position between the frontmost photosensitive drum 6 and the belt 9A while passing through the supply path 4A. The sheet of paper P is conveyed by the belt 9A from the front side to the rear side to sequentially contact the four photosensitive drums 6. The toner image on the surface of the photosensitive drum 6 is transferred to the sheet of paper when the sheet of paper P contacts the photosensitive drum 6.

Next, the sheet of paper P is heated and pressurized when the sheet of paper P passes through a position between the heat roller 10A and the pressure roller 10B. As a result, the toner image is fixed on the sheet of paper P.

Next, the sheet of paper P is discharged to the outside of the housing 2 by passing through the paper discharge path 5A and the paper discharge opening 2A, and is stacked on the paper discharge tray 2B.

2. Configuration Relating to Re-Conveying of Sheet of Paper

The image forming apparatus 1 includes a re-conveying unit 12 having a reversing path 12A and a relay path 12B, a flap 31, a guide part 35, a first stack lever 41L, and a second stack lever 41R. In the image forming apparatus 1, the housing 2 includes a passing opening 2C.

(1) Passing Opening

The passing opening 2C is disposed on an upper rear end part of the housing 2. The passing opening 2C is opened in the front and rear direction. With this configuration, the passing opening 2C lets the outside and the inside of the housing 2 communicate with each other. The passing opening 2C is disposed on the upper rear side of the paper discharge opening 2A. That is, the passing opening 2C is disposed on the upper side of the paper discharge opening 2A in the up and down direction, and is disposed on the rear side of the paper discharge opening 2A in the front and rear direction.

(2) Re-Conveying Unit

The re-conveying unit 12 includes a first reversing roller 21, a first opposing roller 22, a second reversing roller 23 and a second opposing roller 24.

The re-conveying unit 12 is disposed in a rear end part and a lower end part of the image forming apparatus 1. The re-conveying unit 12 is configured to convey the sheet of paper P which has passes through the fixing unit 10 to a midway position on the supply path 4A.

The reversing path 12A is disposed on the rear side of the paper discharge path 5A. The reversing path 12A is formed to extend to the upper rear side from the fixing unit 10, to bend upward after passing through the lower side of the flap 31, and then to bend to the upper front side in a manner similar to the paper discharge path 5A before communicating with the passing opening 2C.

The relay path 12B is formed to extend to the lower front side from a part of the reversing path 12A disposed on the lower side of the flap 31, to extend frontward on the lower side of the paper supply tray 11 after being bent frontward, and further to bend to the upper front side before communicating with the supply path 4A.

The first reversing roller 21 is disposed on the reversing path 12A. The first reversing roller 21 is disposed on the lower rear side of the passing opening 2C to be spaced from the passing opening 2C. The first reversing roller 21 can be rotated by a driving force applied from a driving source M2. The rotational direction of the first reversing roller 21 can be switched between a first rotational direction in which the sheet of paper P is conveyed upward and a second rotational direction which is opposite to the first rotational direction and in which the sheet of paper P is conveyed downward.

The first opposing roller 22 is disposed on the reversing path 12A. The first opposing roller 22 is disposed on the lower front side of the first reversing roller 22. The first opposing roller 22 contacts the first reversing roller 22. The first opposing roller 22 is rotatable by following the first reversing roller 21.

The second reversing roller 23 is disposed on the reversing path 12A. The second reversing roller 23 is disposed oa the lower side of the first reversing roller 21 to be spaced from the first reversing roller 21. The second reversing roller 23 can be rotated by a driving force applied from a driving source M3. The rotational direction of the second reversing roller 23 can be switched between a third rotational direction in which the sheet of paper P is conveyed upward and a fourth rotational direction which is opposite to the third rotational direction and in which the sheet of paper P is conveyed downward.

The second opposing roller 24 is disposed on the reversing path 12A. The second opposing roller 24 is disposed on the front side of the second reversing roller 23. The second opposing roller 24 contacts the second reversing roller 23. The second opposing roller 24 is rotatable by following the second reversing roller 23.

(3) Flap

The flap 31 is disposed on the upper rear side of the fixing unit 10. The flap 31 is disposed between the lower end part of the paper discharge path 5A and the lower end part of the reversing path 12A. The flap 31 has a plat-like shape extending in the up and down direction. The flap 31 is rotatable, about the upper end part of the flap 31, between a discharging position illustrates by a solid line where the flap 31 closes the reversing path 12A and releases the paper discharge path 5A and a conveying position illustrated by a virtual line where the flap 31 releases the reversing path 12A and closes the paper discharge path 5A.

(4) Guide Part

Figure 2:
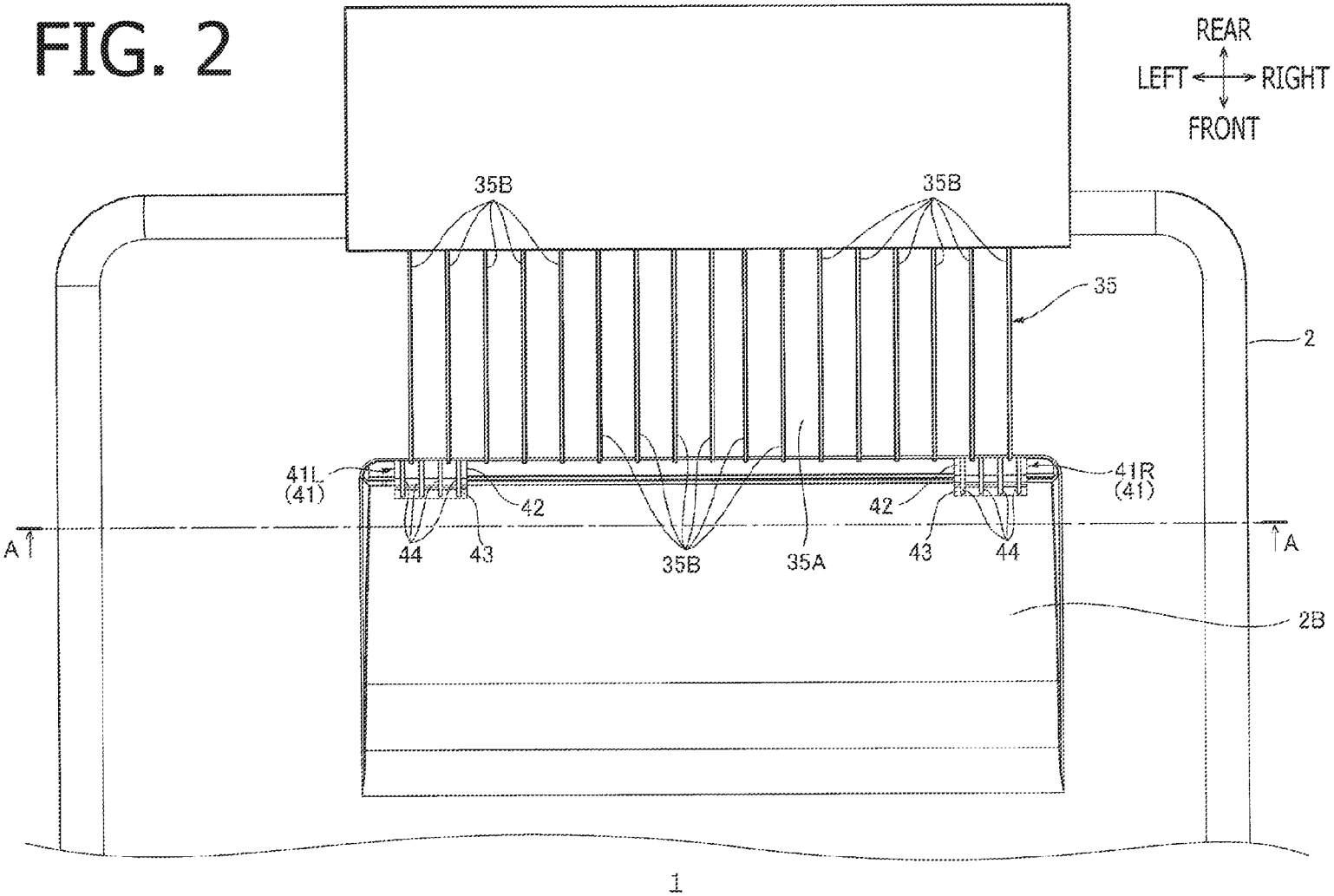
FIG. 2 is a plan view of the printer 1 shown in FIG. 1.

The guide part 35 is a part of the upper surface of the housing 2. Specifically, as shown in FIG. 2, the guide part 35 is a central portion of the upper surface of the housing 2 in the left and right direction and is a rear end part of the upper surface of the housing 2. The guide part 35 is disposed between the paper discharge opening 2A and the passing opening 2C in the front and rear direction. As shown in FIG. 1, the guide part 35 is disposed between the paper discharge opening 2A and the passing opening 2C in the up and down direction. As shown in FIG. 2, the guide part 35 includes a flat surface 35A and a plurality of ribs 35B.

The flat surface 35A forms a lower end surface of the guide part 35. The flat surface 35A has a rectangular shape when viewed as a plan view. The flat surface 35A is formed to extend in the horizontal direction.

The rib 35B projects upward from the flat surface 35A. The rib 35B extends in the front and rear direction. The plurality of ribs 35B are disposed to have constant intervals therebetween in the left and right direction. When projected in the up and down direction, the front edges of the ribs 35 overlap with the paper discharge opening 2A and the rear edges of the ribs 35B overlap with the passing opening 2C (see FIG. 1).

As shown in FIG. 2, the front end part the guide part 35 adjoins the rear end part of the paper discharge tray 2B when viewed as a plan view. As shown in FIG. 1, the rear end part of the guide part 35 forms the lower edge of the passing opening 2C.

(5) First Stack Lever and Second Stack Lever

Figure 3:
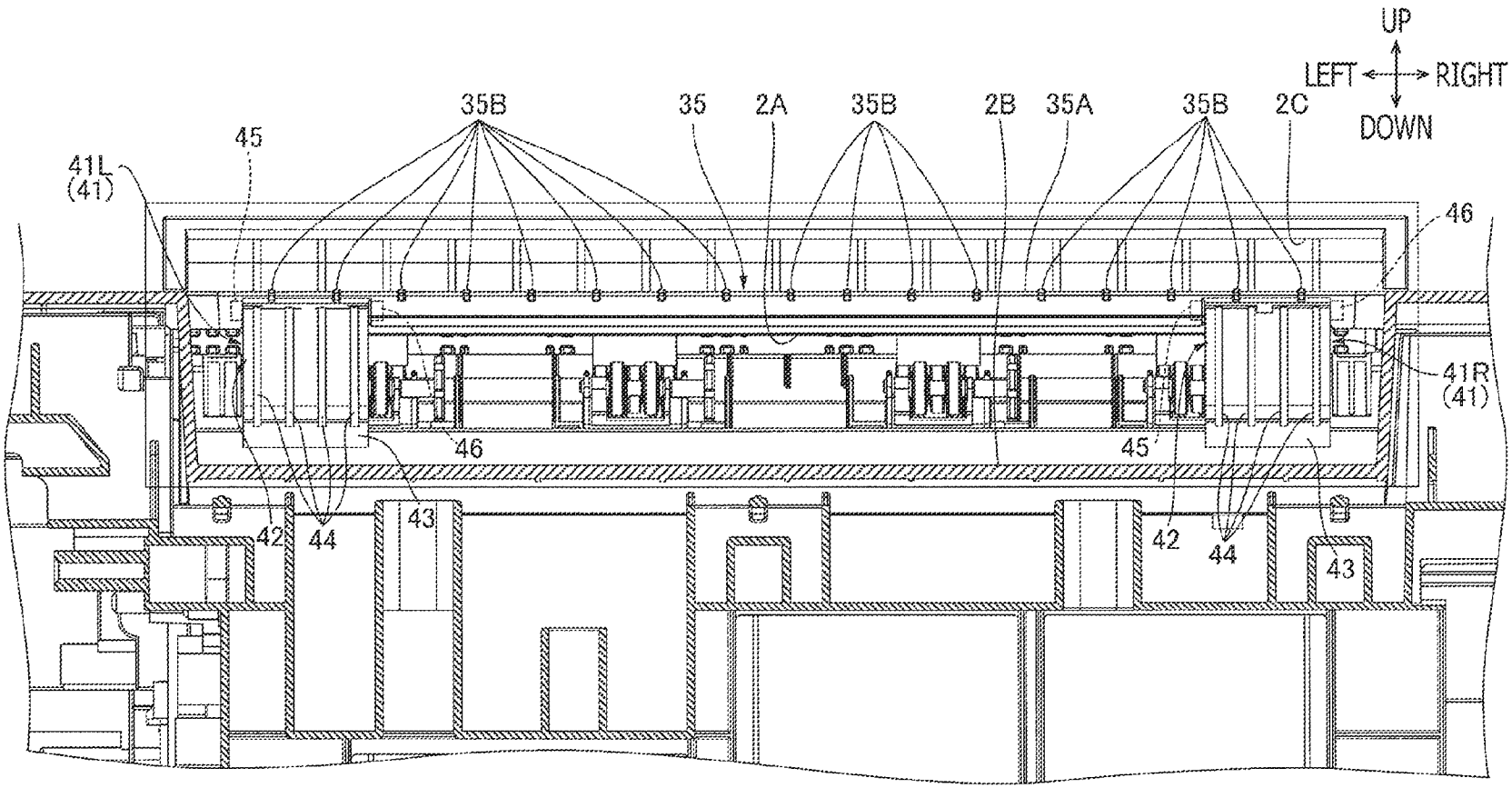
FIG. 3 is an A-A cross section of the printer 1 shown in FIG. 1.
Figure 4:
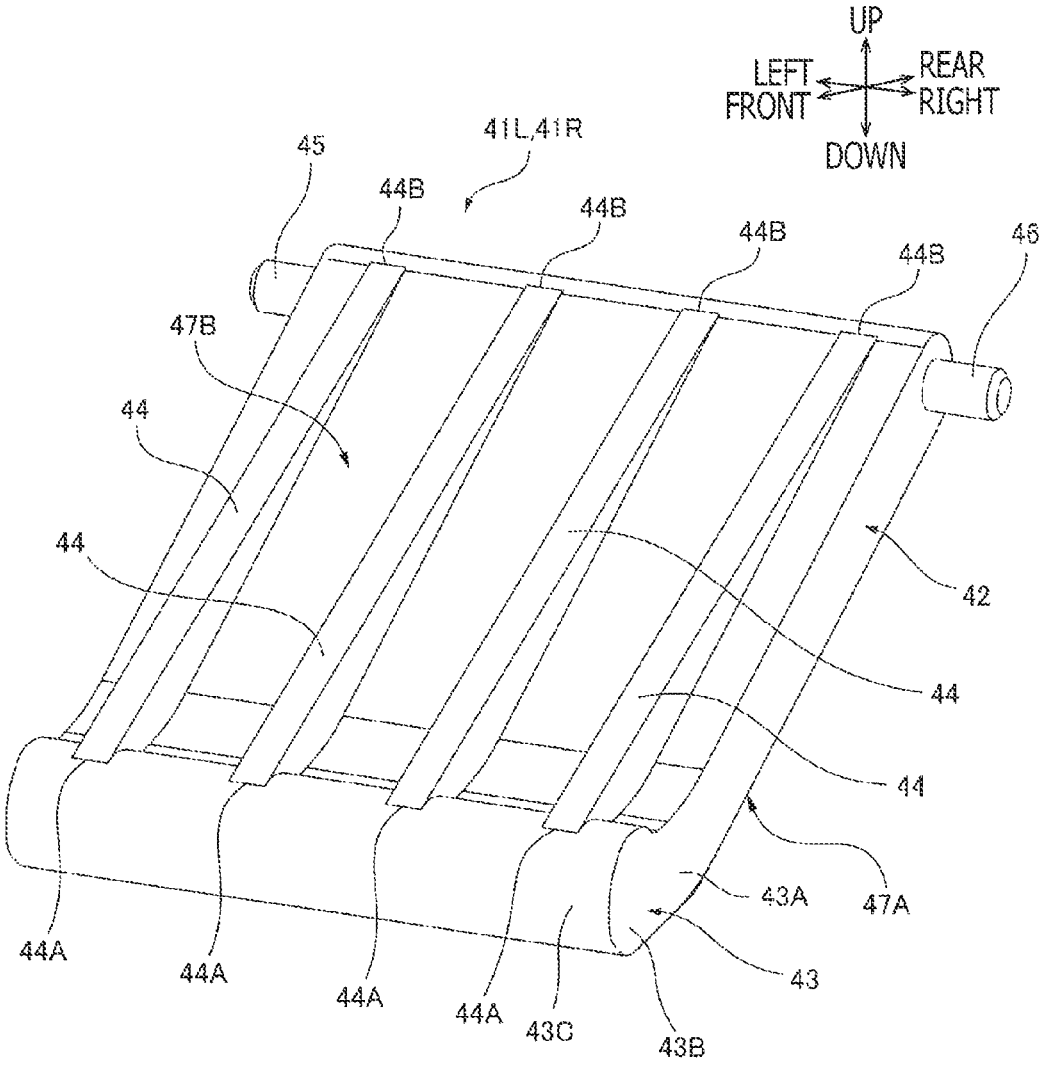
FIG. 4 is a perspective view of a stack lever shown in FIG. 1, viewed from an upper front side.

As shown in FIGS. 2 and 3, the first stack lever 41L is attached to the upper and left part of the housing 2. As shown in FIG. 4, the first stack lever 41L has a plate-like shape extending in the front and rear direction, and comprises a first surface 47A facing the paper discharge opening 2A when the first stack lever 41L is disposed at a position indicated by a virtual line in FIG. 1, and a second surface 47B opposite to the first surface 47A. In the following explanation, the configuration of each of the first stack lever 41L and the second stack lever 41R is explained with reference to a state where each of the first stack lever 41L and the second stack lever 41R is disposed to be along a direction connecting the lower front side with the upper rear side as shown in FIG. 1.

As shown in FIG. 4, the first stack lever 41L includes an extending part 42, a presser part 43 and a plurality of (four in this embodiment) ribs 44.

The extending part 42 is rectangular when viewed as a plan view, and has a plate-like shape extending in the front and rear direction. The extending part 42 has a substantially uniform thickness from the front end part to the rear end part. The extending part 42 includes a first shaft part 45 and a second shaft part 46.

The first shaft part 45 projects leftward from the left surface of the rear end part of the extending part 42. The first shaft part 45 has a columnar shape extending in the left and right direction.

The second shaft part 46 projects rightward from the right surface of the rear end part of the extending part 42. The second shaft part 46 has a columnar shape extending in the left and right direction. When projected in the left and right direction, the second shaft part 46 coincides with the first shaft part 45.

The presser part 43 is formed to extend to the upper front side from the rear end part of the extending part 42. That is, the first stack lever 41L has a bent shape projecting to the lower side. The presser part 43 includes a continuing part 43A and an expanded part 43B.

The continuing part 43A is formed to extend to the upper front side from the front end part of the extending part 42. The thickness of the continuing part 43A gradually increases toward the upper front side.

The expanded part 43B is formed to expand from the front end part of the continuing part 43A toward the upper front side. When viewed in the left and right direction, an outer circumferential surface of the expanded part 43B is bent in a shape of an arc such that the upper front part of the expanded part 43B is expanded.

The rib 44 is formed to project upward from the upper surface of the extending part 42 and the upper surface of the presser part 43. Specifically, the rib 44 linearly extends, in the front and rear direction, from the upper surface of the rear end part of the extending part 42 to the upper surface of the expanded part 43B. A front edge 44A of the upper surface of the rib 44 is disposed on the upper surface of the outer circumferential surface 43C of the expanded part 43B. A rear edge 44B of the upper surface of the rib 44 is disposed on the upper surface of the rear end part of the extending part 42. The plurality of ribs 44 are disposed to have constant intervals therebetween in the left and right direction.

As shown in FIG. 3, the first stack lever 41L is disposed close to the left end part of the paper discharge opening 2A and is disposed on the lower front side of the left end part of the passing opening 2C to be spaced from the left end part of the passing opening 2C. The first stack lever 41L is supported by the housing 2 such that the first shaft part 45 and the second shaft part 46 are rotatably supported by the housing 2. Specifically, the first shaft part 45 and the second haft part 46 of the first stack lever 41L are disposed on the lower side of the guide part 35 and upper side of the paper discharge tray 2B. The first shaft par 45 and the second shaft part 46 of the first stack lever 41L are rotatably supported by a part of the housing 2 close to the left end part of the paper discharge opening 2A.

With this configuration, the first stack lever 41L is able to rotate about an axis extending, at the rear end part of the first stack lever 41L, in the left and right direction. In this embodiment, each of the first stack lever 41L and the second stack lever 41R has the shaft parts 45 and 46 rotatably supported by the housing 2. However, in another embodiment, the housing 2 may have shaft parts and each of the first stack lever 41L and the second stack lever 41R may have holes into which the shaft parts of the housing 2 are inserted so that each of the first stack lever 41L and the second stack lever 41R is rotatably supported by the housing 2.

The second stack lever 41R is disposed close to the right end part of the paper discharge opening 2A, and is disposed on the lower front side of the right end part of the passing opening 2C to be spaced from the passing opening 2C. The second stack lever 41R is attached to the upper and right end part of the housing 2. The second stack lever 41R has substantially the same configuration as that of the first stack lever 41L other than the fact that the second stack lever 41R is attached to the upper and right end part of the housing 2.

Each of the first stack lever 41L and the second stack lever 41R is provided to be able to swing between a first position indicated by a virtual line in FIG. 1 and a second position indicated by a solid line in FIG. 1.

In a state where the first stack lever 41L and the second stack lever 41R are disposed at the first position, the presser part 43 is disposed on the lower front side of the first shaft part 45 and the second shaft part 46.

In a state where the first stack lever 41L and the second stack lever 41R are disposed at the second position, the extending part 42 of each of the first stack lever 41L and the second stack lever 41R is disposed to be along the front and rear direction. In this case, the presser part 43 of each of the first stack lever 41L and the second stack lever 41R disposed at the second position is disposed on the front side relative to the state where the first stack lever 41L and the second stack lever 41R are disposed at the first position. Each of the first stack lever 41L and the second stack lever 41R is bent to project toward the lower side, i.e., the paper discharge tray 2B side. Furthermore, the ribs 44 of the first stack lever 41L disposed at the second position are formed on a surface of the first stack lever 41L opposed to a surface of the first stack lever 41L facing the paper discharge tray 2B, and are separated toward the front side farther from the passing opening 2C relative to the guide part 35. Similarly, the ribs 44 of the second stack lever 41R disposed at the second position are formed on a surface of the second stack lever 41R opposed to a surface of the second stack lever 41R facing the paper discharge tray 2B, and are separated toward the front side farther from the passing opening 2C relative to the guide part 35.

3. Operation of First Stack Lever and Second Stack Lever

In a state where no sheet of paper P is discharged to the paper discharge tray 2B, each of the first stack lever 41L and the second stack lever 41R is disposed at the first position by its own weight.

When the image formation operation is started and the sheet of paper P is stacked on the paper discharge tray 2B, the upper surface of the sheet of paper P on the paper discharge tray 2B contacts the presser part 43 of the first stack lever 41L. Similarly, the upper surface of the sheet of paper P on the paper discharge tray 2B contacts the presser part 43 of the second stack lever 41R.

Then, the sheet of paper P is further stacked on the paper discharge tray 2B, and the upper surface of the sheet of paper P on the paper discharge tray 2B pushes up the presser part 43 of the first stack lever 41L. Similarly, the upper surface of the sheet of paper P on the paper discharge tray 2B pushes up the presser part 43 of the second stack lever 41R. As a result, the first stack lever 41L and the second stack lever 41R rotate in the clockwise direction about the first shaft part 45 and the second shaft part 46, respectively, when viewed as a right side view. Then, each of the first stack lever 41L and the second stack lever 41R rotates toward the second position.

Then, the sheets of paper P discharged to the paper discharge tray 2B are pressed downward by the weights of the first stack lever 41L and the second stack lever 41R.

When the sheets of paper P on the paper discharge tray 2B are subsequently removed, each of the first stack lever 41L and the second stack lever 41R rotates to the first position by its own weight.

4. Conveying of Sheet of Paper to Re-Conveying Path

In the following, conveying of the sheet of paper P to the reversing path 12A in a state where the sheets of paper P are stacked on the paper discharge tray 2B is explained.

When the sheet of paper P is to be conveyed to the reversing path 12A, the flap 31 is disposed at the conveying position.

Then, the sheet of paper P for which printing has been performed on one side of the sheet of paper P passes through the position between the heat roller 10A and the presser roller 10B, and then enters the reversing path 12A while being guided by the flap 31.

Further, the second reversing roller 23 rotates in the third rotational direction, and the second opposing roller 24 rotates following the second reversing roller 23. Further, the first reversing roller 21 rotates in the first rotational direction, and the first opposing roller 22 rotates following the first reversing roller 21.

As a result, the sheet of paper P is conveyed to the upper side.

Then, the sheet of paper P passes through the passing opening 2C, is discharged to the guide part 35, and then is conveyed frontward along the ribs 35B. With this configuration, the sheet of paper P is conveyed frontward in a state where a contact area of the sheet of paper P to the guide part 35 is reduced. In other words, the sheet of paper P is conveyed frontward in a state where the contact resistance is reduced in comparison with the case where the sheet of paper P contacts the entire upper surface of the flat surface 35A.

When the sheet of paper P is conveyed further, the downstream side edge of the sheet of paper P in the conveying direction is disposed on the front side of the rib 35 while crossing over the front edge of the rib 35B. Further, the upstream side edge of the sheet of paper P in the conveying direction passes through the position between the second reversing roller 23 and the second opposing roller 24.

Then, the sheet of paper P is conveyed to the front side along the rib 44 of the first stack lever 41L and the rib 44 of the second stack lever 41R. As a result, the sheet of paper P is conveyed to the front side in a state where the contact resistance is reduced in comparison with the case where the sheet of paper P contacts the entire upper surface of the first stack lever 41L and the entire upper surface of the second stack lever 41R.

Specifically, at this time, the sheet of paper P is conveyed along the upper surfaces of the ribs 44 of the first stack lever 41L and the upper surfaces of the ribs 44 of the second stack lever 41R. Therefore, the sheet of paper P is smoothly conveyed to cross over the expanded part 43B toward the front side without causing a state where the downstream side edge of the sheet of paper P in the conveying direction is hooked to the expanded part 43B of the rib 44 of the first stack lever 41L and the expanded part 43B of the rib 44 of the second stack lever 41R.

Then, the second reversing roller 23 rotates in the fourth rotational direction, and the second opposing roller 24 rotates following the second reversing roller 23. Further, the first reversing roller 21 rotates in the second rotational direction, and the first opposing roller 22 rotates following the first reversing roller 21. Further, the flap 31 is disposed at the discharging position.

Then, the sheet of paper P is conveyed to the second reversing roller 23 and the second opposing roller 24 by rotations of the first reversing roller 21 and the first opposing roller 22.

Specifically, the sheet of paper P is conveyed rearward to the guide part 35 along the rib 44 of the first stack lever 41L and the rib 44 of the second stack lever 41R.

Thereafter, the sheet of paper P is conveyed rearward to the passing opening 2C along the rib 35B of the guide part 35. The sheet of paper P which has passed through the passing opening 2C is conveyed to the second reversing roller 23 and the second opposing roller 24 while passing through the first reversing roller 21 and the first opposing roller 22.

Then, the sheet of paper P is conveyed downward by rotations of the second reversing roller 23 and the second opposing roller 24.

Then, the sheet of paper P enters the relay path 12B.

The sheet of paper P which has entered the relay path 12B is supplied to a midway point on the supply path 4A while passing through the relay path 12B, and is guided to the image forming unit 3.

5. Advantageous Effects (1) As shown in FIG. 1, the image forming apparatus 1 includes the first stack lever 41L and the second stack lever 41R. Further, each of the first stack lever 41L and the second stack lever 41R is disposed at the first position by its own weight when no sheet of paper P is discharged to the paper discharge tray 2B. When the sheet of paper P is discharged to the paper discharge tray 2B and is stacked on the paper discharge tray 2B, each of the first stack lever 41L and the second stack lever 41R is moves from the first position to the second position in a manner of being pushed up by the sheet of paper P, and presses the sheet of paper P by the presser part 43. Furthermore, the ribs 44 are formed on the surface of the first stack lever 41L opposing the surface of the first stack lever 41L facing the paper discharge tray 2B, and similarly the ribs 44 are formed on the surface of the second stack lever 41R opposing the surface the second stack lever 41R facing the paper discharge tray 2B.

Therefore, it becomes possible to convey the sheet of paper P passing through the reversing path 12A and the passing opening 2C to be along the ribs 44 of the first stack lever 41L and the ribs 44 of the second stack lever 41R while making it possible to press the sheets of paper P stacked on the paper discharge tray 2B by the first stack lever 41L and the second stack lever 41R.

As a result, it becomes possible to decrease the contact area of the sheet of paper P in comparison with the case where the sheet of paper P being re-conveyed contacts a surface. That is, it is possible to suppress increase of the conveying resistance of the sheet of paper P in comparison with the case where the sheet of paper P being re-conveyed contacts a surface.

Accordingly, the sheet of paper P can be re-conveyed smoothly.

When the sheet of paper P for which printing has been performed for the both sides thereof is discharged while the sheet of paper P for which printing has been performed only for one side thereof is re-conveyed, the discharged sheets of paper P are stacked on the paper discharge tray 2B such that the discharged sheets of paper P push up the first stack lever 41L and the second stack lever 41R while the sheet of paper P being re-conveyed moves along the ribs 44 of the first stack lever 41L and the ribs 44 of the second stack lever 41R.

Therefore, it becomes possible to prevent the sheet of paper P stacked on the paper discharge tray 2B and the sheet of paper P being re-conveyed from contacting with each other.

(2) As shown in FIG. 1, the image forming apparatus 1 includes the first reversing roller 21 and the second reversing roller 23.

Therefore, by rotating the first reversing roller 21 in the second rotational direction after rotating the first reversing roller 21 in the first rotational direction and by rotating the second reversing roller 23 in the fourth rotational direction after rotating the second reversing roller 23 in the third rotational direction, it is possible to convey the sheet of paper P in a direction departing from the passing opening 2C after conveying the sheet of paper P toward the passing opening 2C.

Accordingly, it is possible to re-convey the sheet of paper P by switching the rotational direction of the first reversing roller 21 and the second reversing roller 23.

(3) As shown in FIG. 1, in the image forming apparatus 1, each of the first stack lever 41L and the second stack lever 41R is bent such that each of the first stack lever 41L and the second stack lever 41R projects toward the lower side, i.e., toward the paper discharge tray 2B side.

Therefore, it is possible to securely press the sheets of paper P discharged to the paper discharge tray 2B.

(4) As shown in FIG. 4, in the image forming apparatus 1, the rib 44 of each of the first stack lever 41L and the second stack lever 41R extends linearly between the rear end part of the extending part 42 and the front end part of the presser part 43.

Accordingly, it is possible to smoothly convey the sheet of paper P along the ribs 44.

(5) As shown in FIG. 1, in the image forming apparatus 1, the passing opening 2C is disposed on the rear side of the paper discharge opening 2A.

Therefore, in the case where the sheet of paper P which has passed though the passing opening 2C is conveyed toward the paper discharge tray 2B, the sheet of paper P being conveyed does not contact the sheet of paper P stacked on the paper discharge tray 2B while the sheet of paper P is conveyed from the passing opening 2C to the position close to the paper discharge opening 2A.

Therefore, it is possible to prevent the sheet of paper P being re-conveyed and the sheet of paper P stacked on the paper discharge tray 2B from contacting with each other.

As a result, it becomes possible to re-convey the sheet of paper P more smoothly.

(6) As shown in FIG. 1, in the image forming apparatus 1, the guide part 35 is disposed between the passing opening 2C and the paper discharge tray 2B in the up and down direction, and forms the lower periphery of the passing opening 2C.

Therefore, it is possible to convey the sheet of paper P passing through the reversing path 12A and the passing opening 2C to be along the guide part 35.

As a result, it becomes possible to more suitably prevent the conveying speed of the sheet of paper P passing through the reversing path 12A and the passing opening 2C from decreasing.

(7) As shown in FIG. 1, in the image forming apparatus 1, the guide part 35 is disposed on the upper side of the first shaft part 45 and the second shaft part 46 of the first stack lever 41L and the first shaft part 45 and the second shaft part 41R of the second stack lever 41R.

Therefore, it is possible to smoothly convey the sheet of paper P to be along the ribs 44 of the first stack lever 41L and the ribs 44 of the second stack lever 41R.

(8) As shown in FIG. 1, in the image forming apparatus 1, the guide part 35 is the upper surface of the housing 2, and the paper discharge tray 2B is formed to be recessed downward from the upper surface of the housing 2.

Therefore, the number of components in the image forming apparatus 1 is reduced.

(9) As shown in FIG. 1, in the image forming apparatus 1, the guide part 35 includes the ribs 44 configured to reduce the contact resistance with respect to the sheet of paper P.

In this case, the sheet of paper P being conveyed contacts the ribs 44.

Therefore, the sheet of paper P can be smoothly re-conveyed.

Furthermore, the guide part 35 can be formed easily.

(10) As shown in FIG. 4, in the image forming apparatus 1, the ribs 44 are arranged at constant intervals in the left and right direction.

Therefore, it is possible to let the sheet of paper P contact the ribs 44.

As a result, it becomes possible to suppress decreasing of the conveying speed of the sheet of paper P.

(11) As shown in FIG. 1, in the image forming apparatus 1, the ribs 44 are disposed on the front side of the guide part 35 when the first stack lever 41L and the second stack lever 41R are disposed at the second position.

Therefore, the sheet of paper P conveyed along the guide part 35 by passing through the passing opening 2C is conveyed along the ribs 44 after being conveyed along the guide part 35.

Therefore, the sheet of paper P can be conveyed smoothly.

(12) As shown in FIG. 1, the image forming apparatus 1 includes the supply path 4A, the paper discharge path 5A, the reversing path 12A and the relay path 12B.

Therefore, it is possible to convey the sheet of paper P which has passed through the fixing unit 10 toward the image forming unit 3 again, by conveying the sheet of paper P in a direction of moving away from the passing opening 2C after letting the sheet of paper P enter the reversing path 12A, and then conveying the sheet of paper P on the relay path 12B and letting the sheet of paper P enter the supply path 4A. Then, an image can be formed, by the image forming unit 3, on a side of the sheet of paper P on which an image has not been formed.

(13) As shown in FIG. 1, the image forming apparatus 1 includes the flap 31 which is able to move between the first guide position and the second guide position.

Therefore, it is possible to securely guide the sheet of paper P to the paper discharge path 5A or the reversing path 12A.

Second Embodiment

Hereafter, an image forming apparatus 50 according to a second embodiment is explained. In the following explanation, to elements which are similar to those of the first embodiment, similar reference numbers are assigned, and explanations thereof will not be repeated.

In the above described first embodiment, the ribs 35B are formed to extend from the passing opening 2C to the front edge of the guide part 35.

Figure 5:
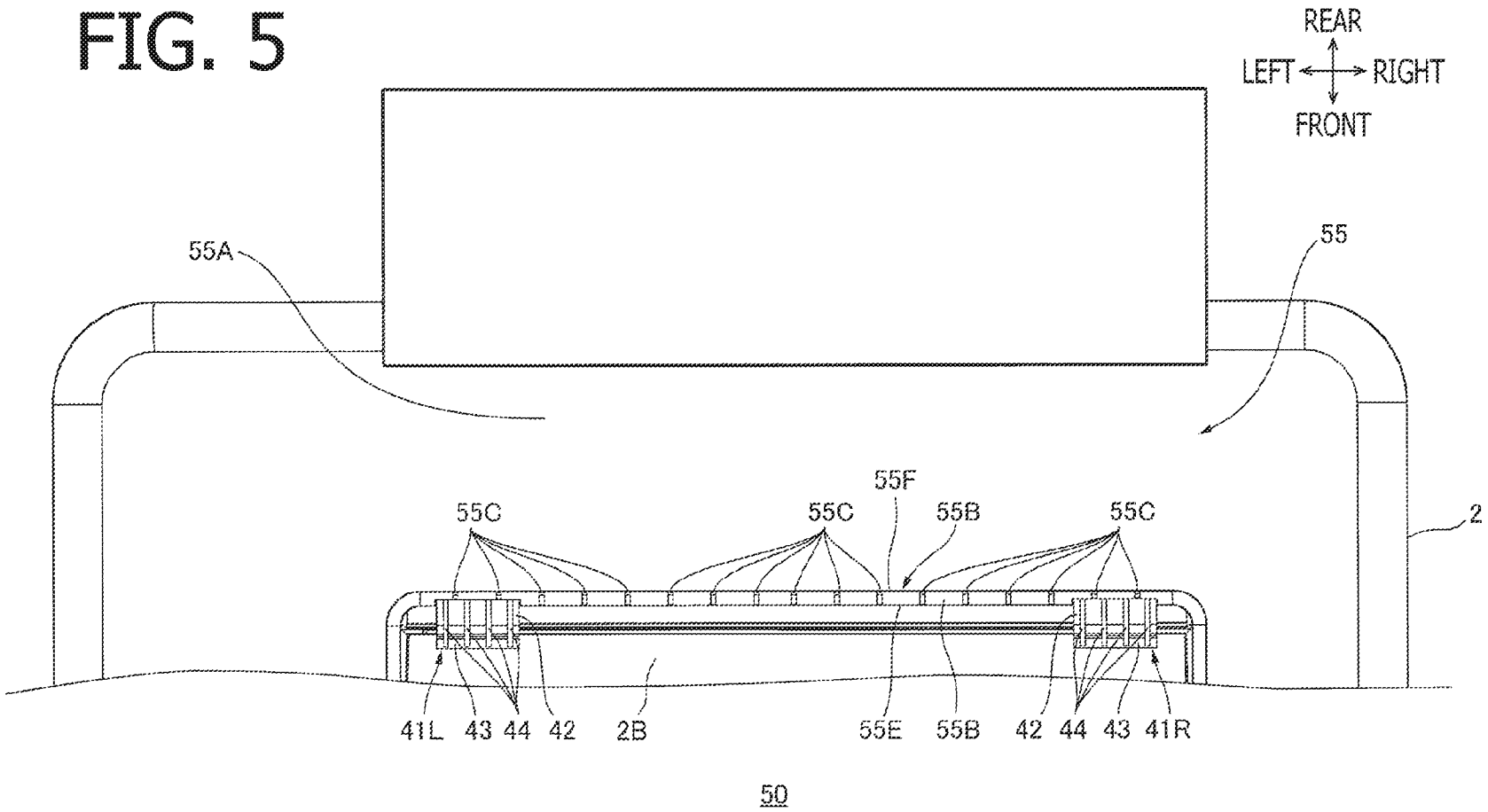
FIG. 5 is a plan view of a printer according to a second embodiment.
Figure 6:
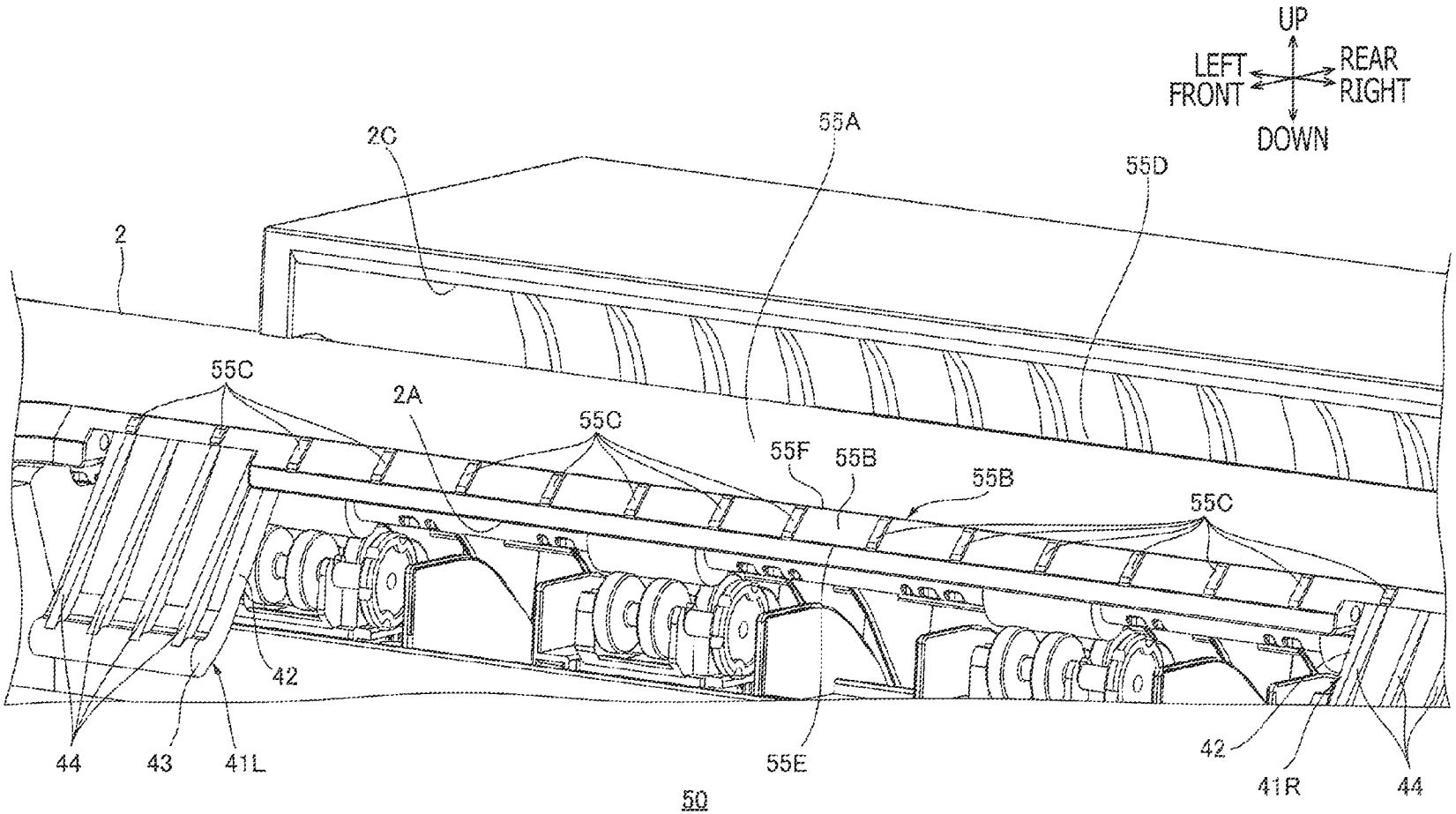
FIG. 6 is an enlarged perspective view of a central portion of the printer 1 shown in FIG. 5 viewed from an upper front side.

By contrast, according to the second embodiment, as shown in FIGS. 5 and 6, ribs 55*c* are formed on the front side of the passing opening 2C to be spaced from the passing opening 2C.

Specifically, according to the second embodiment, the image forming apparatus 1 includes a guide part 55 in place of the guide part 35.

The guide part 55 is formed in a rear end part on the upper surface of the housing 2 and in a central part in the left and right direction. The guide part 55 includes a flat part 55A, an inclined part 55B, and the plurality of ribs 55C.

The flat surface 55A is formed to extend in the horizontal direction. As shown in FIG. 6, a rear edge 55D of the flat surface 55A forms a lower periphery of the passing opening 2C, and extends in the left and right direction.

As shown in FIGS. 5 and 6, the inclined surface 55B is formed to extend to the lower front side to be continued from the flat surface 55A. A front edge 55E of the inclined surface 55B extends in the left and right direction to be along the paper discharge opening 2A. A rear edge 55F of the inclined surface 55B extends in the left and right direction in parallel with the front edge 55E, and is disposed on the upper rear side of the front edge 55E.

The rib 55C projects upward from the inclined surface 55B. The rib 55C extends in the front and rear direction. The front edge of the rib 55C coincides with the front edge 55E of the inclined surface 55B and a rear edge of the rib 55C coincides with the rear edge 55F of the inclined surface 55B. That is, the rib 55C is disposed to extend between the front edge 55E of the inclined surface 55B and the rear edge 55F of the inclined surface 55B. The rib 55C is disposed in the front end part of the guide part 55. The rib 55C is disposed on the front side of the passing opening 2C across the flat surface 55A, and is spaced from the passing opening 2C.

The sheet of paper P being conveyed frontward by passing through the passing opening 2C is conveyed frontward along the ribs 55C, and is conveyed along the ribs 44 of the first stack lever 41L and the ribs 44 of the second stack lever 41L.

According to the image forming apparatus 50 of the second embodiment, the same advantageous effects as those attained by the first embodiment can be attained.

Furthermore, according to the image forming apparatus of the second embodiment, as shown in FIGS. 5 and 6, the ribs 55C are disposed on the inclined surface 55B. Further, the front edge of the rib 55C coincides with the front edge 55E of the inclined surface 55B.

In this configuration, the sheet of paper P which has passes through the passing opening 2C hangs downward such that the front edge of the sheet of paper P contacts the first stack lever 41L and the second stack lever 41R. Then, the sheet of paper P contacts the front edge 55E of the inclined surface 5B.

Therefore, the ribs 55C are disposed at positions which the sheet of paper P likely contacts when the sheet of paper P disposed on the top surface of the paper discharge tray 2B is re-conveyed.

Therefore, it becomes possible to cause the sheet of paper P being re-conveyed to contact the ribs 55C effectively.

As a result, it becomes possible to more smoothly re-convey the sheet of paper P.

What is claimed is:

1. An image forming apparatus, comprising:

a housing having a sheet discharge tray, a first opening, a second opening disposed higher, in a vertical direction, than the first opening, and a guide part configured to guide one or more sheets discharged from the second opening;

a discharge roller disposed at the first opening, wherein an end portion of the guide part in a sheet discharge direction overlaps the discharge roller from above;

an image forming unit configured to form an image on a sheet;

a sheet discharge path configured to guide the sheet from the image forming unit to the sheet discharge tray, the sheet discharge path communicating with the first opening;

a re-conveying path configured to be disposed side by side with the sheet discharge path in a horizontal direction and to guide the sheet to the image forming unit, the re-conveying path communicating with the second opening; and a swinging member disposed to face the first opening, the swinging member comprising a first surface facing the first opening and a second surface opposite to the first surface, wherein:

the swinging member further comprises a first end area at which the swinging member is swingably supported by the housing, a second end area opposing the first end area and disposed downstream of the end portion of the guide part in the sheet discharge direction, and a rib formed to extend from the first end area to the second end area;

the swinging member is disposed to be movable between a first position and a second position at which the second end area is disposed at a position higher than a position of the second end area when the swinging member is disposed at the first position; and the rib is formed on the second surface of the swinging member opposing the first surface of the swinging member facing the sheet discharge tray in a state where the swinging member is disposed at the second position, the rib being configured to contact and guide the sheet discharged from the second opening.

2. The image forming apparatus according to claim 1, further comprising a reversing roller disposed on the re-conveying path, a rotational direction of the reversing roller being switchable between a first rotational direction in which the sheet is conveyed to the second opening and a second rotational direction opposite to the first rotational direction.

3. The image forming apparatus according to claim 1, wherein the swinging member is formed to be bent such that the swinging member is projected toward the sheet discharge tray in a state where the swinging member is disposed at the second position.

4. The image forming apparatus according to claim 1, wherein the rib linearly extends between the first end area and the second end area.

5. The image forming apparatus according to claim 1, wherein the second opening is disposed closer to the re-conveying path than the first opening in the horizontal direction.

6. The image forming apparatus according to claim 1, wherein the guide part is disposed between the first opening and the second opening in the vertical direction, the guide part defining a bottom boundary of the second opening.

7. The image forming apparatus according to claim 1, wherein:

the swinging member comprises a shaft part disposed in the first end area and swingably supported by the housing; and the guide part overlaps the shaft part of the swinging member from above.

8. The image forming apparatus according to claim 1, wherein:

the guide part forms at least a part of an upper surface of the housing; and the sheet discharge tray is formed to be recessed to a lower side from the upper surface of the housing.

9. The image forming apparatus according to claim 1, wherein the guide part comprises a contacting part configured to reduce contact resistance with the one or more sheets.

10. The image forming apparatus according to claim 9, wherein:

the guide part comprises a first edge and a second edge, wherein the first edge is disposed closer to the sheet discharge tray than the second edge, and wherein the second edge is disposed closer to the second opening than the first edge; and the contacting part is disposed at least at the first edge.

11. The image forming apparatus according to claim 9, wherein the contacting part is a rib extending in the horizontal direction.

12. The image forming apparatus according to claim 9, wherein the contacting part comprises a plurality of contacting components arranged to have intervals therebetween in a width direction which is orthogonal to both of the vertical direction and the horizontal direction.

13. The image forming apparatus according to claim 1, wherein the rib of the swinging member is disposed at a position farther from the second opening in the horizontal direction relative to the guide part in a state where the swinging member is disposed at the second position than in a state where the swinging member is disposed at the first position.

14. The image forming apparatus according to claim 1, further comprising:

a photosensitive drum;

a transfer unit configured to transfer a developer image on a surface of the photosensitive drum to the sheet;

a fixing unit configured to fix the developer image on the sheet;

a supply path disposed on an upstream side with respect to the transfer unit in a first conveying direction in which the sheet is conveyed to the transfer unit; and a relay path formed to continue to the supply path and the re-conveying path, wherein:

the sheet discharge path is disposed on a downstream side with respect to the fixing unit in a second conveying direction in which the sheet which passed through the fixing unit is conveyed to the first opening; and the re-conveying path is disposed on a downstream side with respect to the fixing unit in a third direction in which the sheet which has passed through the fixing unit is conveyed to the second opening.

15. The image forming apparatus according to claim 1, further comprising a switching unit configured to move between a first guide position at which the sheet is guided to the sheet discharge path and a second guide position at which the sheet is guided to the re-conveying path.

* * * * *